US011754091B2

(12) United States Patent
Lin et al.

(10) Patent No.: US 11,754,091 B2
(45) Date of Patent: Sep. 12, 2023

(54) INDUCED DRAFT FAN

(71) Applicant: Zhongshan Broad-Ocean Motor Co., Ltd., Zhongshan (CN)

(72) Inventors: Yanhu Lin, Zhongshan (CN); Haiqi Lin, Zhongshan (CN); Miao Zhang, Zhongshan (CN); Hongbin Wang, Zhongshan (CN); Liewei Guo, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 101 days.

(21) Appl. No.: 17/531,775

(22) Filed: Nov. 21, 2021

(65) Prior Publication Data

US 2022/0074425 A1 Mar. 10, 2022

Related U.S. Application Data

(63) Continuation-in-part of application No. PCT/CN2020/084033, filed on Apr. 9, 2020.

(30) Foreign Application Priority Data

Dec. 27, 2019 (CN) ..... 201922393724.8

(51) Int. Cl.
*F04D 29/42* (2006.01)

(52) U.S. Cl.
CPC ..... *F04D 29/4233* (2013.01)

(58) Field of Classification Search
CPC . F04D 29/4226; F04D 29/4233; F04D 29/441
See application file for complete search history.

(56) References Cited

U.S. PATENT DOCUMENTS

| | | | | |
|---|---|---|---|---|
| 6,902,373 | B1 * | 6/2005 | Glanton | F04D 29/441 415/214.1 |
| 8,475,146 | B2 * | 7/2013 | Liu | F04D 29/4226 415/206 |
| 10,113,557 | B2 * | 10/2018 | Hutson | F04D 29/4226 |

FOREIGN PATENT DOCUMENTS

| | | | |
|---|---|---|---|
| CN | 207500160 U | | 6/2018 |
| CN | 208417004 U | | 1/2019 |
| CN | 208417036 U | * | 1/2019 |
| CN | 208417036 U | | 1/2019 |
| CN | 208634102 U | | 3/2019 |
| JP | 07133796 A | | 5/1995 |

* cited by examiner

*Primary Examiner* — Sabbir Hasan
(74) *Attorney, Agent, or Firm* — Matthias Scholl P.C.; Matthias Scholl

(57) ABSTRACT

An induced draft fan includes a motor, a volute, a wind wheel, and a conversion interface. The volute includes a cavity for accommodating the wind wheel. The volute further includes a bottom surface and a side surface. The bottom surface includes an air inlet and the side surface includes an air outlet. The air inlet and the air outlet communicate with the cavity. The conversion interface includes a connection section, a transition section, and an exit section. The connection section and the exit section are disposed on two ends of the transition section, respectively. The transition section tilts upward so that the exit section and the connection section are staggered with each other. The connection section includes a rectangular hollow frame including an upper side plate, a lower side plate, a left side plate, and a right side plate.

9 Claims, 12 Drawing Sheets

INDUCED DRAFT FAN

CROSS-REFERENCE TO RELAYED APPLICATIONS

This application is a continuation-in-part of International Patent Application No. PCT/CN2020/084033 with an international filing date of Apr. 9, 2020, designating the United States, now pending, and further claims foreign priority benefits to Chinese Patent Application No. 201922393724.8 filed Dec. 27, 2019. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an induced draft fan.

A conventional induced draft fan includes a motor, a volute, a wind wheel, and a conversion interface. The volute includes an air inlet and an air outlet. The conversion interface is disposed at the air outlet. The conversion interface includes a connection section, a transition section, and an exit section. The connection section is provided with a plurality of installation holes, and the volute is provided with a plurality of screw holes corresponding to the plurality of installation holes. When the screws are screwed up into the screw holes through the installation holes, the conversion interface is fixed on the volute. The processing of the installation holes of the connection section is troublesome, and upon assembly, the screws are screwed up from various directions, which is inconvenient to operate. In addition, the gap between the volute and the conversion interface is large thus leading to poor sealing effect. When the pressure is high, there may be air leakage from the gap between the conversion interface and the volute.

SUMMARY

The disclosure provides an induced draft fan, comprising a motor, a volute, a wind wheel, and a conversion interface. The volute comprises a cavity for accommodating the wind wheel; the volute further comprises a bottom surface and a side surface; the bottom surface comprises an air inlet and the side surface comprises an air outlet; the air inlet and the air outlet communicate with the cavity; the conversion interface is disposed on an outlet end of the volute; the conversion interface comprises a connection section, a transition section, and an exit section; the connection section and the exit section are disposed on two ends of the transition section, respectively; the transition section tilts upward so that the exit section and the connection section are staggered with each other; the connection section comprises a rectangular hollow frame comprising an upper side plate, a lower side plate, a left side plate, and a right side plate; the connection section further comprises a convex plate disposed on and parallel to the upper side plate, and a groove is formed between the convex plate and the upper side plate; and the volute further comprises a top plate, a lower plate, and two side plates; the top plate, the lower plate, and the two side plates enclose the air outlet; when the conversion interface is connected to the volute, the connection section is embedded in the air outlet, and the top plate is embedded in the groove.

In a class of this embodiment, the two side plates each comprise a first flange; two side joints of the connection section and the transition section each comprise a first step; and when the conversion interface is connected to the volute, the first flange is secured to the first step.

In a class of this embodiment, the lower plate comprises a second flange; a bottom joint of the connection section and the transition section comprises a second step; and when the conversion interface is connected to the volute, the second flange is secured to the second step.

In a class of this embodiment, the connection section, the transition section, the exit section, and the convex plate form an integrated structure.

In a class of this embodiment, a joint of the exit section and the transition section are provided with a plurality of locating lugs.

The following advantages are associated with the induced draft fan of the disclosure.

The induced draft fan of the disclosure comprises a motor, a volute, a wind wheel, and a conversion interface. The volute comprises a cavity for accommodating the wind wheel; the volute further comprises a bottom surface and a side surface; the bottom surface comprises an air inlet and the side surface comprises an air outlet; the air inlet and the air outlet communicate with the cavity; the conversion interface is disposed on an outlet end of the volute; the conversion interface comprises a connection section, a transition section, and an exit section; the connection section and the exit section are disposed on two ends of the transition section, respectively; the transition section tilts upward so that the exit section and the connection section are staggered with each other; the connection section comprises a rectangular hollow frame comprising an upper side plate, a lower side plate, a left side plate, and a right side plate; the connection section further comprises a convex plate disposed on and parallel to the upper side plate, and a groove is formed between the convex plate and the upper side plate; and the volute further comprises a top plate, a lower plate, and two side plates; the top plate, the lower plate, and the two side plates enclose the air outlet; when the conversion interface is connected to the volute, the connection section is embedded in the air outlet, and the top plate is embedded in the groove. Thus, the sealing between the conversion interface and the air outlet is improved, thus improving the performance and efficiency of the fan, and reducing the potential safety hazards caused by air leakage.

and

Figure 1:
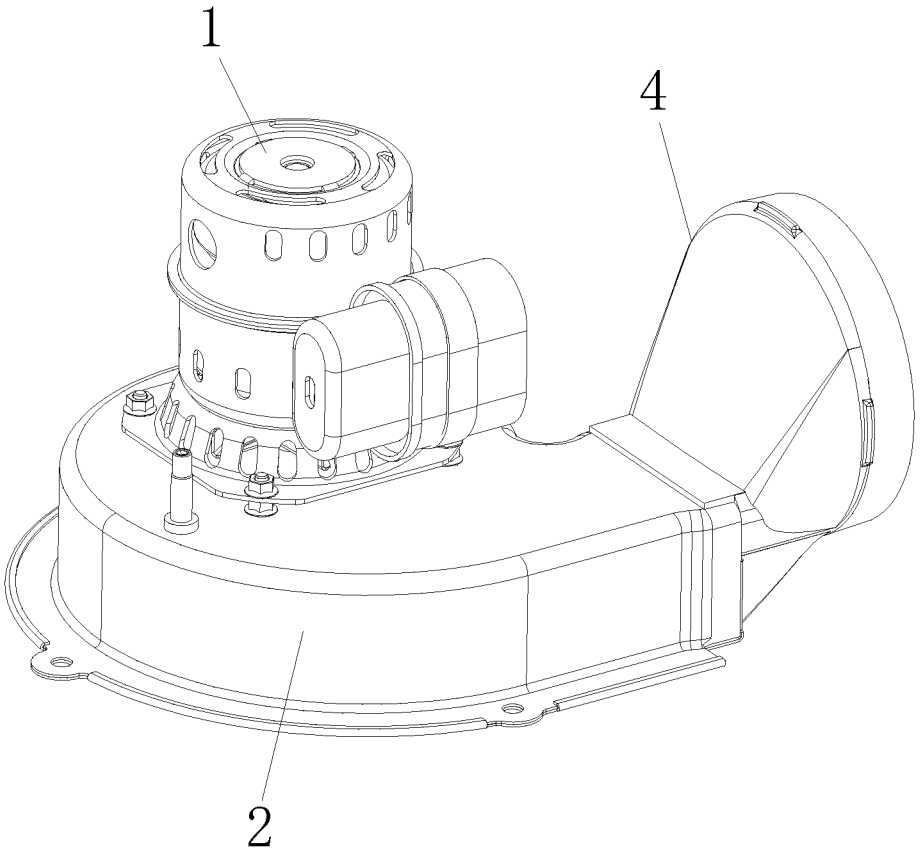
FIG. 1 is a first schematic diagram of an induced draft fan of the disclosure.
Figure 2:
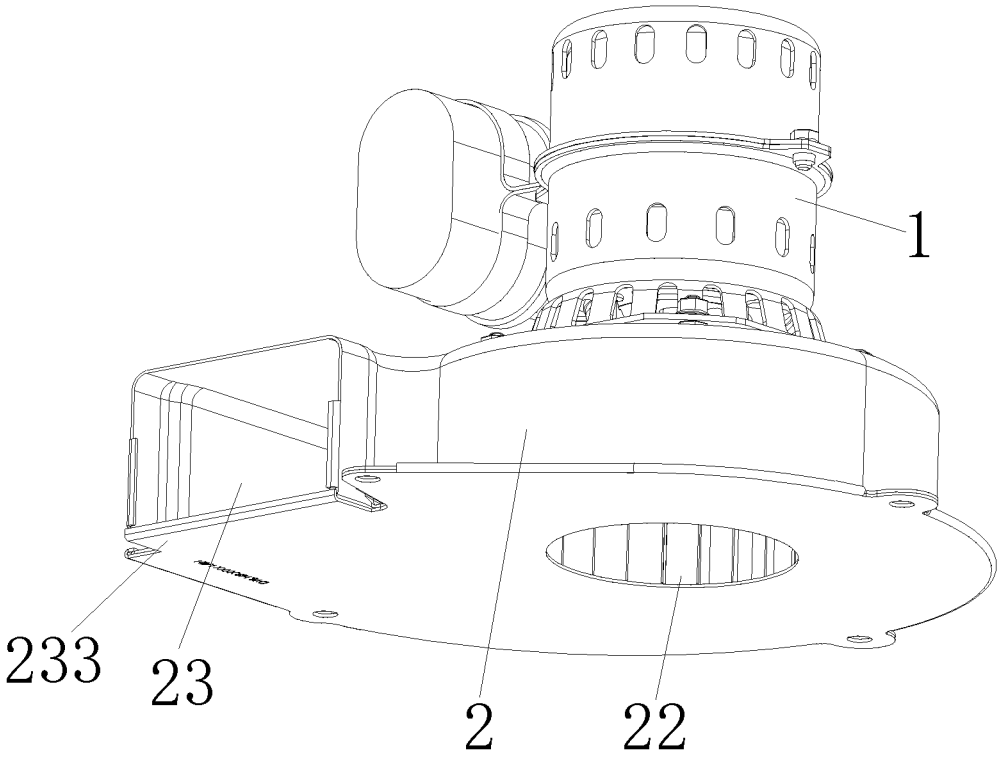
FIG. 2 is a second schematic diagram of an induced draft fan of the disclosure.
Figure 3:
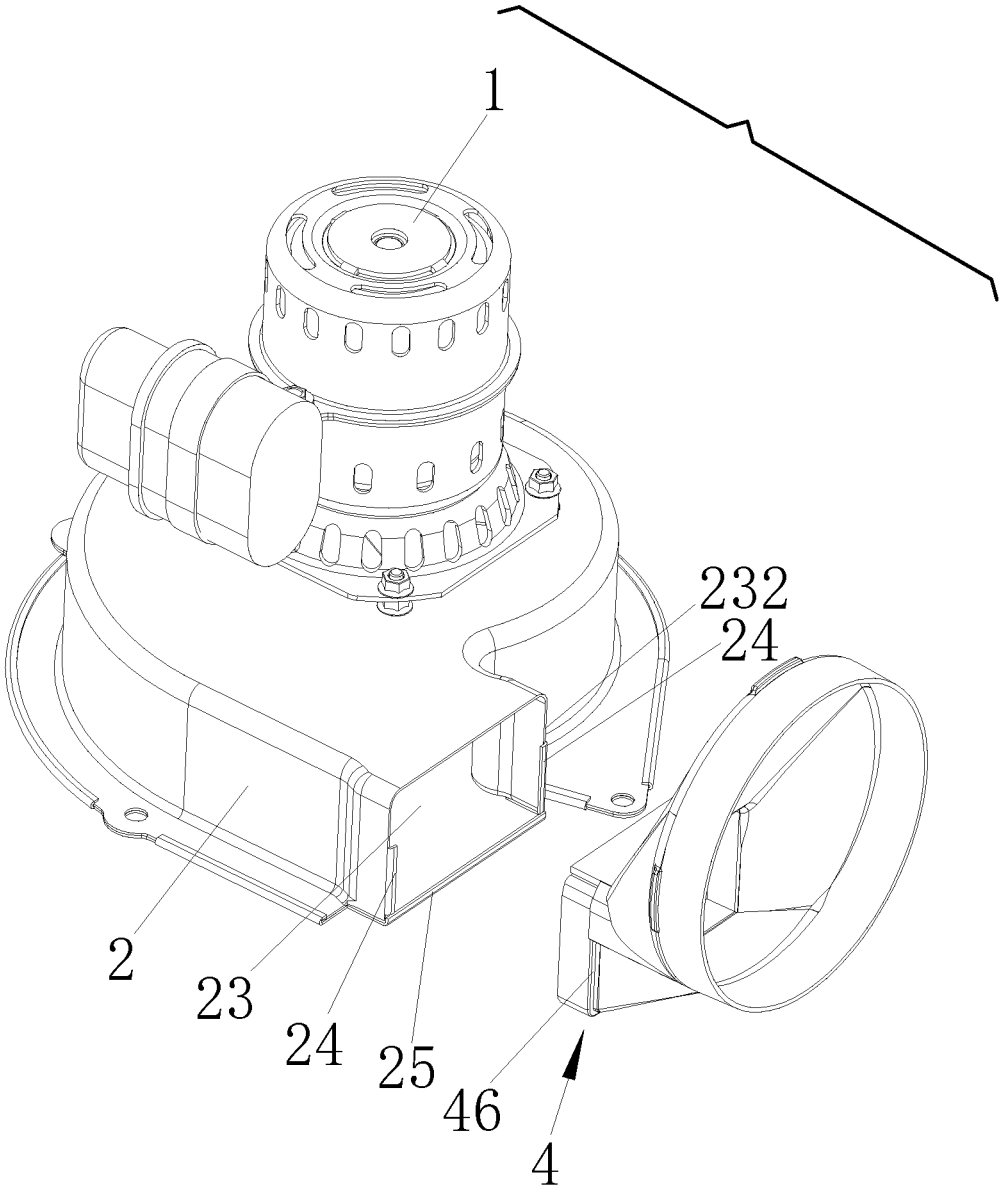
FIG. 3 is a first exploded view an induced draft fan of the disclosure.
Figure 4:
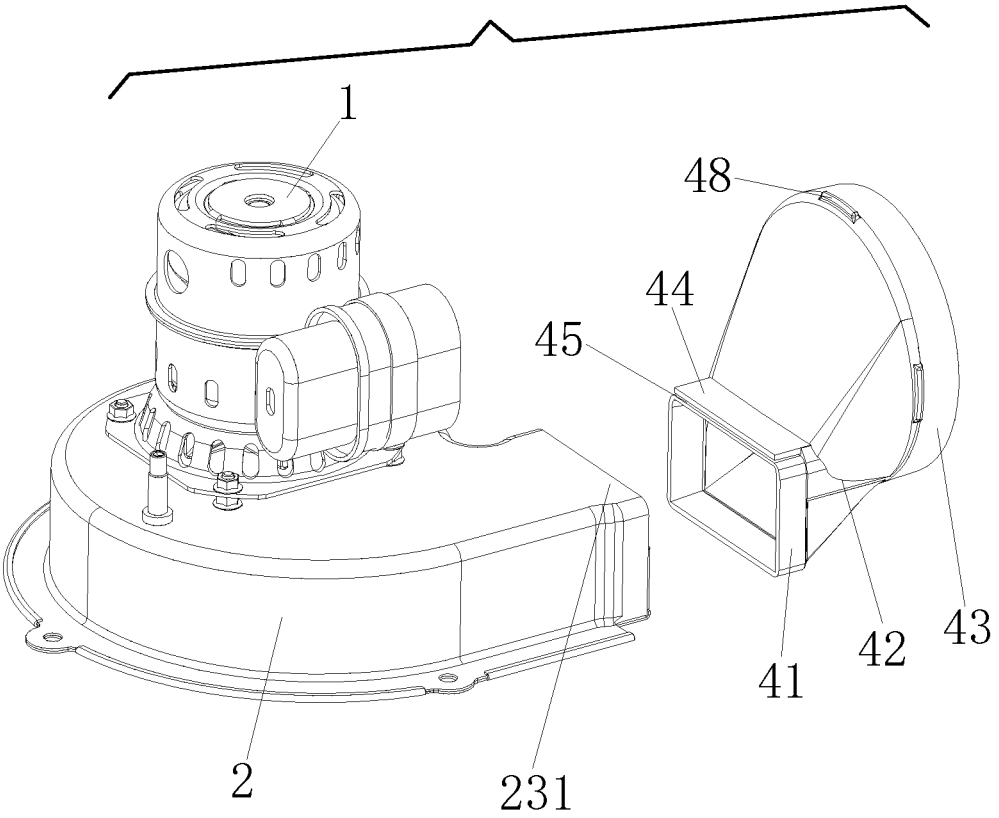
FIG. 4 is a second exploded view an induced draft fan of the disclosure.
Figure 5:
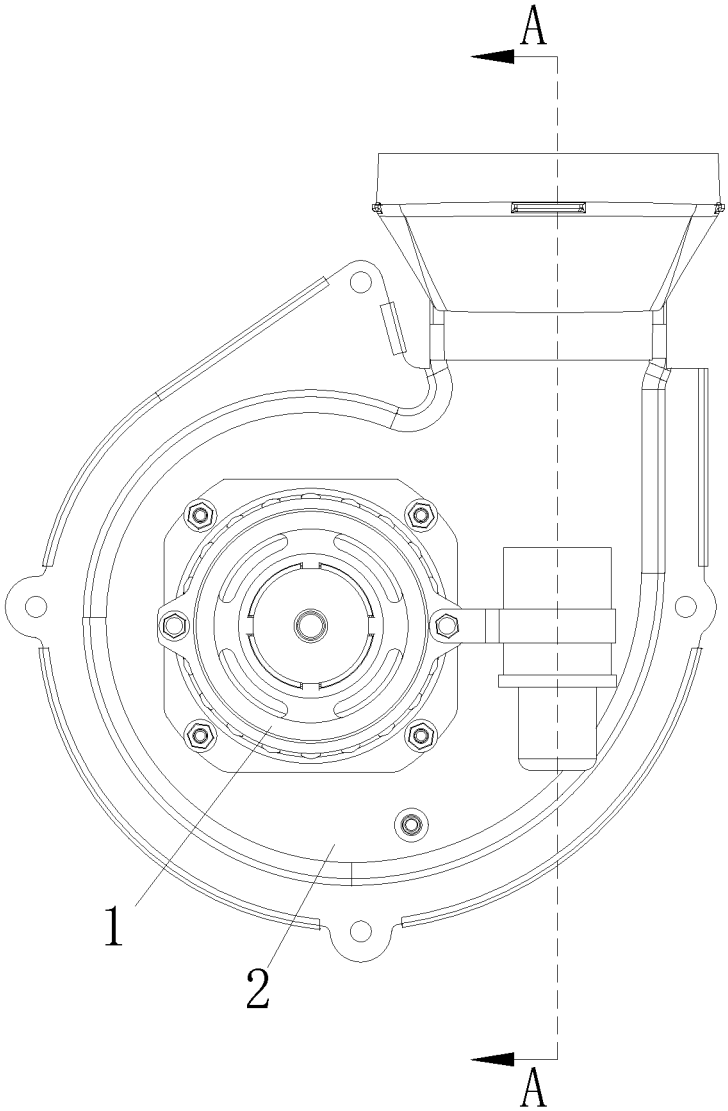
FIG. 5 is a top view of an induced draft fan of the disclosure.
Figure 6:
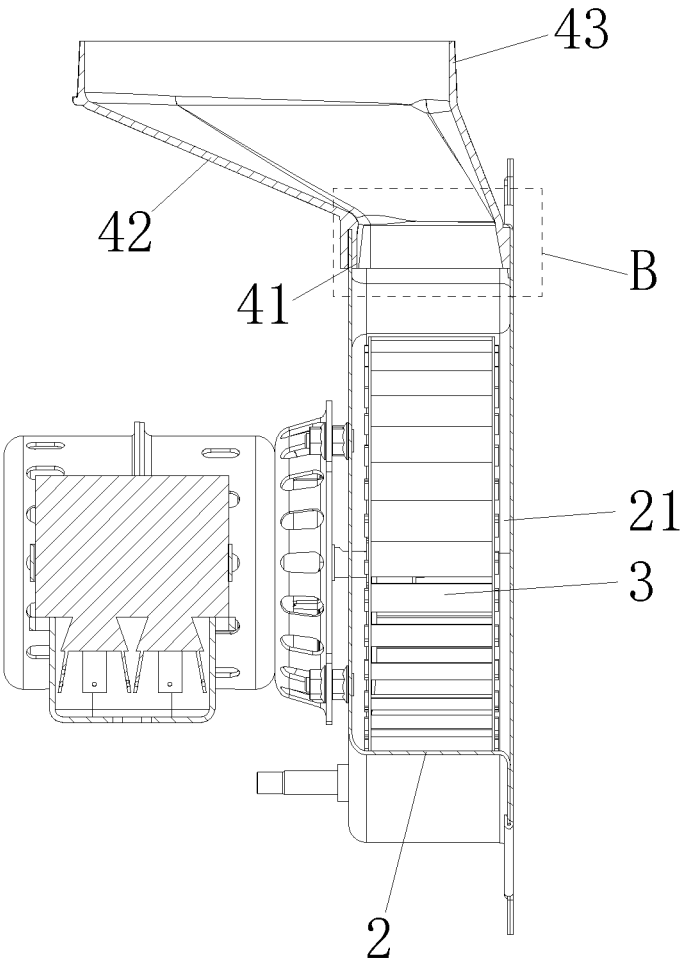
FIG. 6 is a sectional view taken from line A-A in FIG. 5.
Figure 7:
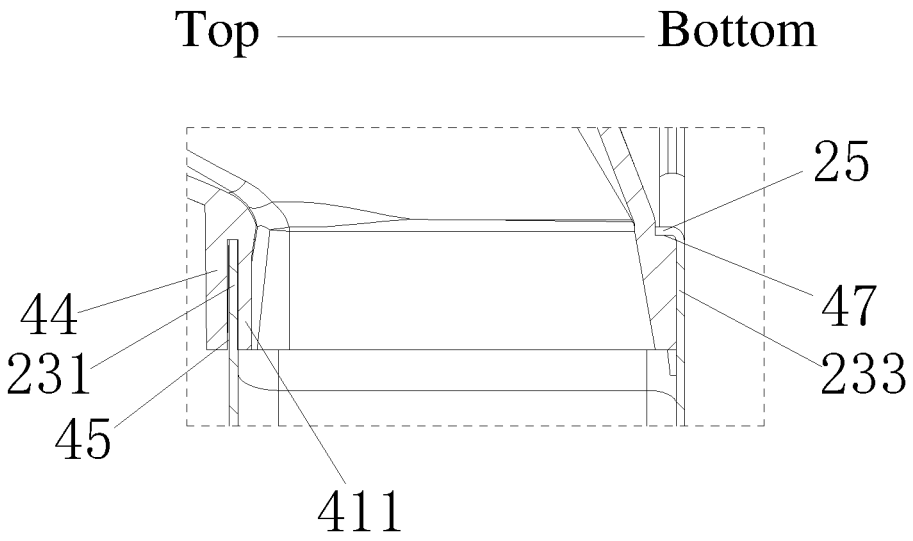
FIG. 7 is a local enlarge view of part B in FIG. 6.
Figure 8:
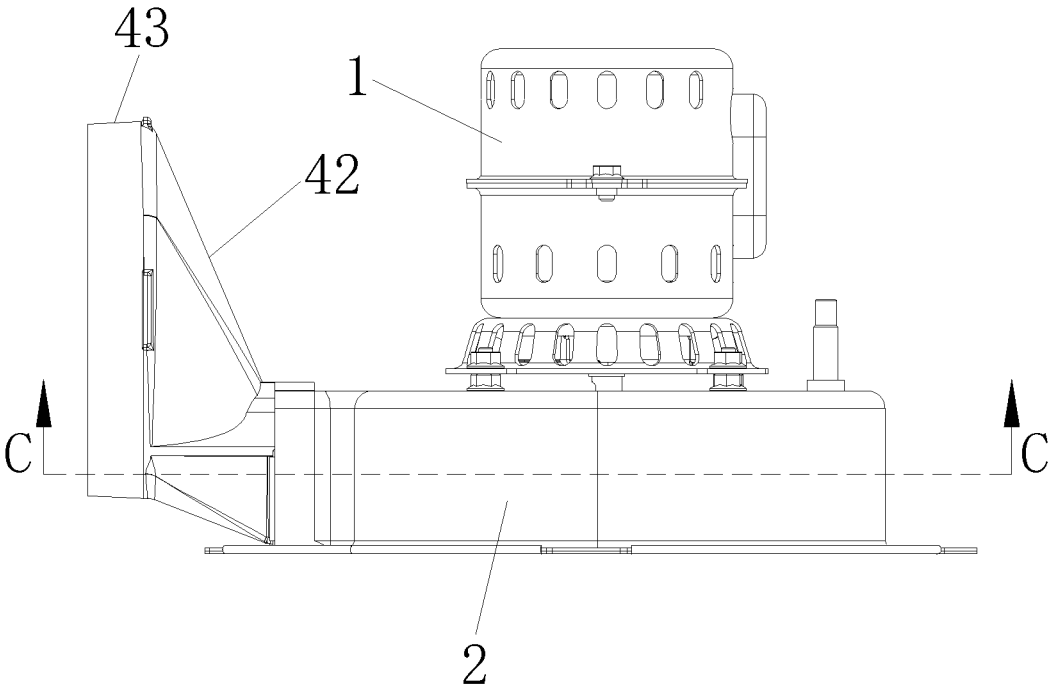
FIG. 8 is a front view of an induced draft fan of the disclosure.
Figure 9:
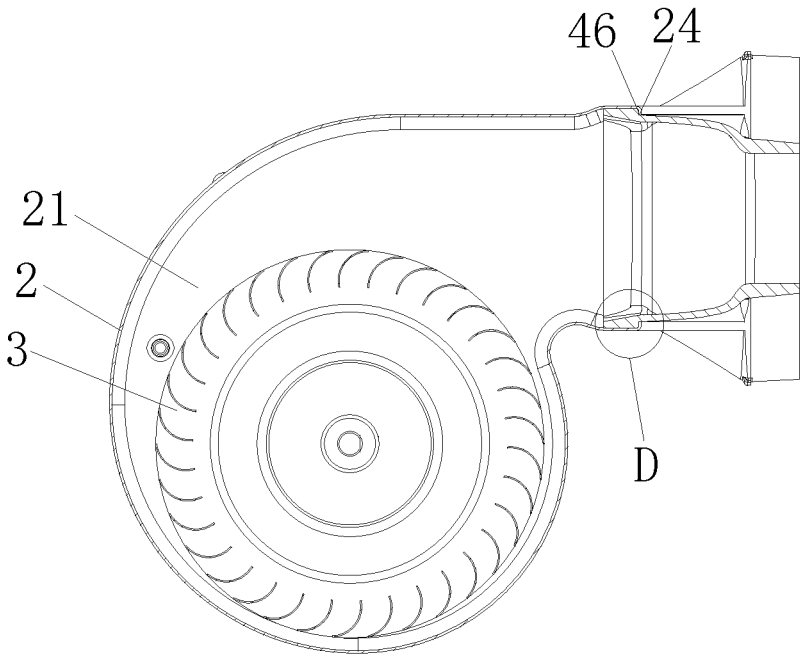
FIG. 9 is a sectional view taken from line C-C in FIG. 8.
Figure 10:
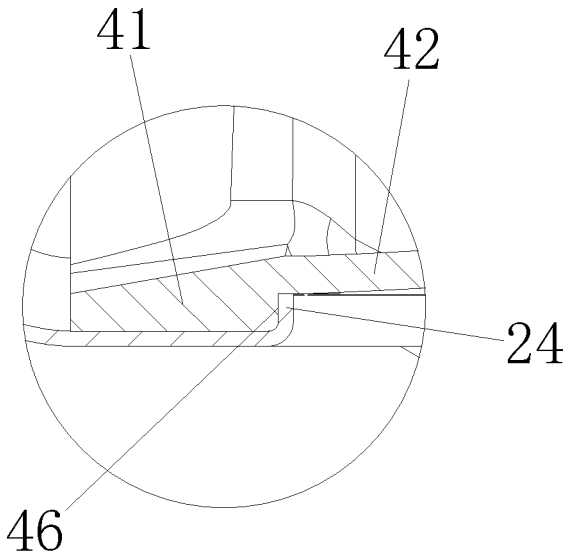
FIG. 10 is a local enlarge view of part D in FIG. 9.
Figure 11:
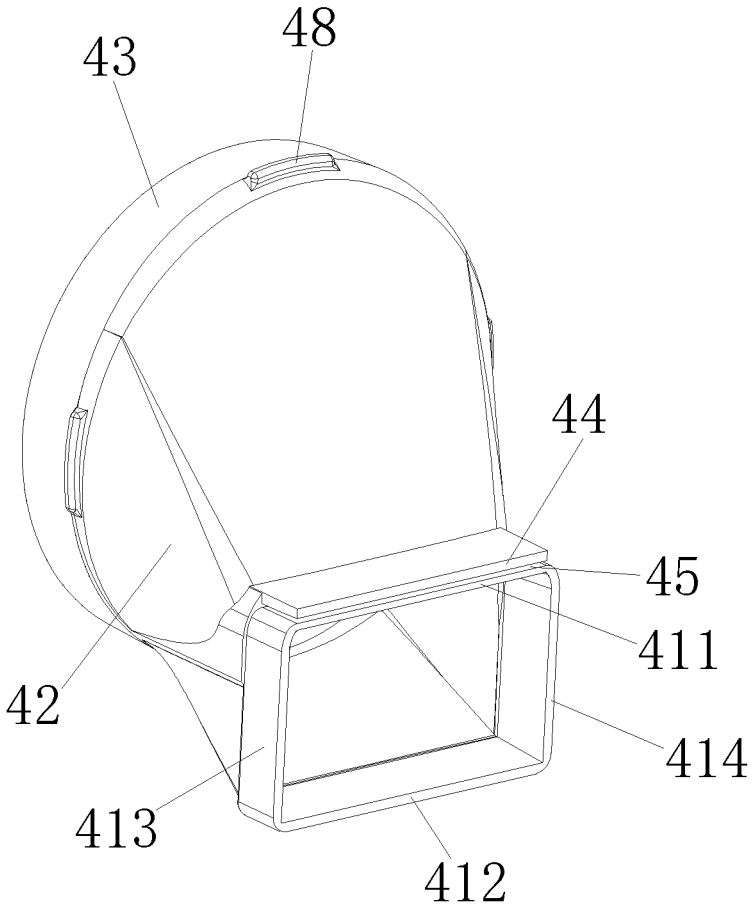
FIG. 11 is a first schematic diagram of a conversion interface of the disclosure.
Figure 12:
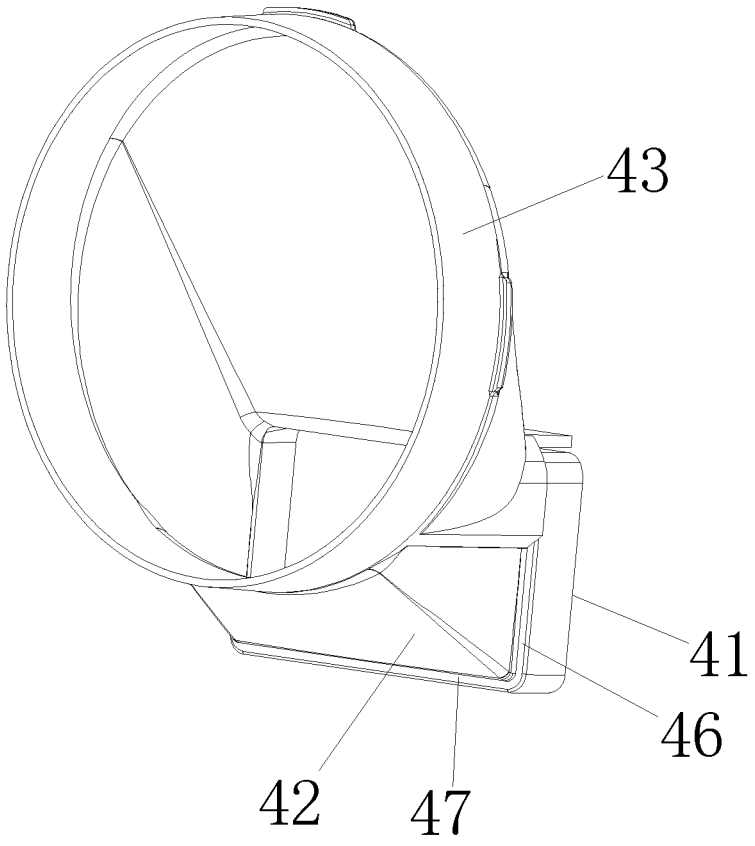

FIG. 12 is a second schematic diagram of a conversion interface of the disclosure.

DETAILED DESCRIPTION

To further illustrate, embodiments detailing an induced draft fan are described below. It should be noted that the following embodiments are intended to describe and not to limit the disclosure.

As shown in FIGS. 1-12, the disclosure provides an induced draft fan comprising a motor 1, a volute 2, a wind wheel 3, and a conversion interface 4. The volute 2 comprises a cavity for accommodating the wind wheel 3; the volute 2 further comprises a bottom surface and a side surface; the bottom surface comprises an air inlet 22 and the side surface comprises an air outlet 23; the air inlet and the air outlet communicate with the cavity 21; the conversion interface 4 is disposed on an outlet end of the volute; the conversion interface 4 comprises a connection section 41, a transition section 42, and an exit section 43; the connection section 41 and the exit section 43 are disposed on two ends of the transition section 42, respectively; the transition section 42 tilts upward so that the exit section 43 and the connection section 41 are staggered with each other; the connection section 41 comprises a rectangular hollow frame comprising an upper side plate 411, a lower side plate 412, a left side plate 413, and a right side plate 414; the connection section 41 further comprises a convex plate 44 disposed on and parallel to the upper side plate 411, and a groove 45 is formed between the convex plate 44 and the upper side plate 411; and the volute 2 further comprises a top plate 231, a lower plate 233, and two side plates 232; the top plate 231, the lower plate 233, and the two side plates 232 enclose the air outlet; when the conversion interface 4 is connected to the volute 23, the connection section 41 is embedded in the air outlet 23, and the top plate 231 is embedded in the groove 45. In this way, the sealing between the conversion interface 4 and the air outlet 23 is improved, thus improving the performance and efficiency of the fan, and reducing the potential safety hazards caused by air leakage.

The two side plates 232 each comprise a first flange 24; two side joints of the connection section 41 and the transition section 42 each comprise a first step 46; and when the conversion interface 4 is connected to the volute 23, the first flange 24 is secured to the first step 46. In this way, the connection of the conversion interface 4 and the volute is firm, thus preventing the detachment of the conversion interface 4 from the volute 23.

The lower plate 233 comprise a second flange 25; a bottom joint of the connection section 41 and the transition section 42 comprises a second step 47; and when the conversion interface 4 is connected to the volute 23, the second flange 25 is secured to the second step 47. In this way, the sealing between the conversion interface 4 and the air outlet 23 is improved, thus improving the performance and efficiency of the fan, and reducing the potential safety hazards caused by air leakage.

The connection section 41, the transition section 42, the exit section 43, and the convex plate 44 form an integrated structure.

The joint of the exit section 43 and the transition section 42 are provided with a plurality of locating lugs 48. The plurality of locating lugs is configured to limit a smoke pipe connected to the exit section, thus facilitating the installation of the smoke pipe and the conversion interface.

It will be obvious to those skilled in the art that changes and modifications may be made, and therefore, the aim in the appended claims is to cover all such changes and modifications.

What is claimed is:

1. A device, comprising:

a motor;

a volute;

a wind wheel; and a conversion interface;

wherein:

the volute comprises a cavity for accommodating the wind wheel;

the volute further comprises a bottom surface and a side surface; the bottom surface comprises an air inlet and the side surface comprises an air outlet; the air inlet and the air outlet communicate with the cavity;

the conversion interface is disposed on an outlet end of the volute;

the conversion interface comprises a connection section, a transition section, and an exit section; the connection section and the exit section are disposed on two ends of the transition section, respectively;

the transition section tilts upward so that the exit section and the connection section are staggered with each other;

the connection section comprises a rectangular hollow frame comprising an upper side plate, a lower side plate, a left side plate, and a right side plate;

the connection section further comprises a convex plate disposed on and parallel to the upper side plate, and a groove is formed between the convex plate and the upper side plate; and the volute further comprises a top plate, a lower plate, and two side plates; the top plate, the lower plate, and the two side plates enclose the air outlet;

when the conversion interface is connected to the volute, the connection section is embedded in the air outlet, and the top plate is embedded in the groove.

2. The device of claim 1, wherein the two side plates each comprise a first flange; two side joints of the connection section and the transition section each comprise a first step; and when the conversion interface is connected to the volute, the first flange is secured to the first step.

3. The device of claim 2, wherein the lower plate comprises a second flange; a bottom joint of the connection section and the transition section comprises a second step; and when the conversion interface is connected to the volute, the second flange is secured to the second step.

4. The device of claim 1, wherein the connection section, the transition section, the exit section, and the convex plate form an integrated structure.

5. The device of claim 2, wherein the connection section, the transition section, the exit section, and the convex plate form an integrated structure.

6. The device of claim 3, wherein the connection section, the transition section, the exit section, and the convex plate form an integrated structure.

7. The device of claim 4, wherein a joint of the exit section and the transition section are provided with a plurality of locating lugs.

8. The device of claim 5, wherein a joint of the exit section and the transition section are provided with a plurality of locating lugs.

9. The device of claim 6, wherein a joint of the exit section and the transition section are provided with a plurality of locating lugs.

* * * * *